US011660778B2

(12) United States Patent
Menzel et al.

(10) Patent No.: US 11,660,778 B2
(45) Date of Patent: May 30, 2023

(54) MOLDING PART, CASTING MOLD AND A METHOD FOR FORMING A GREEN BODY

(71) Applicant: DORST Technologies GmbH & Co. KG, Kochel am See (DE)

(72) Inventors: Roland Menzel, Kochel am See (DE); Sebastian Leonhard Bauer, Wackersberg (DE); Benedikt Schöffmann, Bichl (DE)

(73) Assignee: Dorst Technologies GmbH & Co. KG, Kochel am See (DE)

( * ) Notice: Subject to any disclaimer, the term of this patent is extended or adjusted under 35 U.S.C. 154(b) by 231 days.

(21) Appl. No.: 16/759,375

(22) PCT Filed: Nov. 7, 2018

(86) PCT No.: PCT/EP2018/080440
§ 371 (c)(1),
(2) Date: Apr. 27, 2020

(87) PCT Pub. No.: WO2019/092004
PCT Pub. Date: May 16, 2019

(65) Prior Publication Data

US 2020/0269465 A1 Aug. 27, 2020

(30) Foreign Application Priority Data

Nov. 13, 2017 (EP) ..... 17201424

(51) Int. Cl.
*B28B 1/26* (2006.01)

(52) U.S. Cl.
CPC ..... *B28B 1/262* (2013.01); *B28B 1/266* (2013.01)

(58) Field of Classification Search
CPC ..... B28B 1/265; B28B 1/266
See application file for complete search history.

(56) References Cited

U.S. PATENT DOCUMENTS

| | | | | |
|---|---|---|---|---|
| 4,882,111 | A | 11/1989 | Murata | |
| 2009/0278275 | A1 * | 11/2009 | Morandi | B28B 7/0011 425/85 |

FOREIGN PATENT DOCUMENTS

| | | | | |
|---|---|---|---|---|
| CN | 203 510 426 | U | 4/2014 | |
| DE | 20 22 731 | A1 | 12/1971 | |
| DE | 35 02 348 | A1 | 7/1986 | |
| DE | 10 2005 036 906 | A1 | 4/2007 | |
| DE | 10 2011 117 764 | A1 | 5/2013 | |
| EP | 0 389 234 | A2 | 9/1990 | |
| EP | 389234 | B1 * | 3/1994 | B28B 1/261 |

(Continued)

OTHER PUBLICATIONS

European Search Report Corresponding to 17 20 1424 dated Apr. 18, 2018.

(Continued)

*Primary Examiner* — Kelly M Gambetta
*Assistant Examiner* — Virak Nguon
(74) *Attorney, Agent, or Firm* — Finch & Maloney PLLC

(57) ABSTRACT

A moulded part (1) for a mould (100). The moulded part (1) comprises at least one shell (11) for casting a product. A flange (12) is arranged on a frame of the moulded part (1) for sealing against abutment a sealing surface (13). The shell (11) has a first permeability for a fluid and the flange (12) has a second permeability for the fluid. The second permeability is less than the first permeability.

8 Claims, 8 Drawing Sheets

(56) References Cited

FOREIGN PATENT DOCUMENTS

| | | | | |
|---|---|---|---|---|
| EP | 3 162 521 | A1 | | 5/2017 |
| JP | H03-83608 | A | | 4/1991 |
| JP | 07256616 | A | * | 10/1995 |
| JP | H07-256616 | A | | 10/1995 |

OTHER PUBLICATIONS

Extended European Search Report Corresponding to 17 20 1424 dated Jul. 5, 2018.
International Search Report Corresponding to PCT/EP2018/080440 dated Mar. 11, 2019.
Written Opinion Corresponding to PCT/EP2018/080440 dated Mar. 11, 2019.

* cited by examiner

MOLDING PART, CASTING MOLD AND A METHOD FOR FORMING A GREEN BODY

This application is a National Stage completion of PCT/EP2018/080440 filed Nov. 7, 2018, which claims priority from European patent application Ser. No. 1720142.3 filed Nov. 13, 2017.

FIELD OF THE INVENTION

The present invention relates to a molded part for a casting mold, a casting mold with at least one molded part and a process for molding a green compact.

BACKGROUND OF THE INVENTION

Various casting molds and molded parts for casting molds are known from the prior art. Such a casting mold is known from EP 3 162 521 A1, for example. EP 3 162 521 A1 shows a casting mold in general form. The casting mold has a first upper molded part and a second lower molded part. The molded parts are inserted between two press bodies and are moved together by these. A mold space is formed between the molded parts.

Typically, the molded parts each have a porous or permeable edge layer on their surface facing the mold cavity. Air and liquid can be discharged through this edge layer. It is conceivable that the casting mold has only one molded part or more than two molded parts.

The lower molded part of the casting mold made of EP 3 162 521 A1 has an outlet pipe for discharging water or air. This outlet pipe is connected to the porous layer.

The EP 3 162 521 A1 casting mold and molded parts are relatively large and heavy and therefore relatively difficult to handle. In addition, the drainage of the slurry that is filled in between the molded parts is uneven.

SUMMARY OF THE INVENTION

It is therefore the task of the invention to remedy these and other disadvantages of the prior art. In particular, a molded part for a casting mold is to be provided which allows the uniform drainage of the blank. In addition, a molded part is to be provided which enables a simple production of blanks and/or green compacts. In particular, a corresponding process is to be provided.

These and other tasks are solved by the devices and processes defined in the independent patent claims. Further designs result from the dependent patent claims.

A molded part for a casting mold according to the invention, in particular for a multi-part casting mold, comprises at least one shell for casting a particularly ceramic product. A flange is arranged on an edge of this molded part for sealing contact with a sealing surface and in particular for sealing contact with a second molded part. The shell has a first permeability for a fluid and the flange has a second permeability for the fluid. The second permeability is smaller than the first permeability.

The permeability is defined as the volume of a fluid which can be passed through a solid per hour, per square decimeter and per pressure: $1/(h*dm^2*bar)$.

Different permeabilities for the shell and flange allow specific control of the fluid flow within the molded part. In particular, this means that a fluid in a mold cavity is discharged via the shell of the molded part and not via the flange of the molded part. The discharge flow is thus directed. In particular, the shell comprises a floor area and a wall area.

Preferably, the flange is cast onto the shell, in particular it is manufactured in one piece with the shell.

The flange and the shell are thus an integral part of the molded part and are thus subject to the same shrinkage. Production is simplified and the molded part does not have any unnecessary parting lines.

Preferably, the shell and the flange are made of essentially the same material. In particular, the material properties of the material of the shell and the material of the flange are essentially the same. The material is preferably a plastic and especially PMMA.

Manufacturing from the same material improves the properties of the molded part. The material properties are the same for the entire molded part.

The shell of the molded part preferably has a permeability of at least $10\ l/(h*dm^2*bar)$. Alternatively or additionally the permeability of the flange is maximum $1\ l/(h*dm^2*bar)$.

The molded part may have a sealing, which is preferably designed as a circumferential seal. This seal is preferably arranged in or on the flange.

This makes it possible to seal the molded part on a sealing surface during installation, in particular to close and/or seal the molded space from the environment.

A sealing also makes it possible to manufacture the flange with a larger tolerance, since the sealing effect can be provided by the sealing and not by the flange.

The flange can preferably have a recess in which the sealing is inserted. The sealing is preferably cast into the flange.

This secures the sealing in the flange and protects it against loss.

The recess can have an undercut.

The protection against loss is thus increased.

The molded part in question can be made up of several parts, and in particular have an inner and an outer layer.

In this case, inner layer means that it faces the mold cavity and thus the later green compact.

A further aspect of the present invention concerns a casting mold with at least one and preferably two molded parts as described above. Such a casting mold enables the production of ceramic products in particular and the series production of a desired geometry.

A further aspect of the invention relates to a molded part, in particular a molded part as described herein, wherein at least one drainage channel is provided in the molded part. The drainage channel has at least one drainage channel end, via which liquids can be drained off by means of a drain pipe. The molded part has a detachable coupling for detachably connecting the end of the drainage channel with the discharge pipe.

This enables the individual coupling and uncoupling of the discharge pipe. In particular, it is conceivable that the drainage channel end is designed as a coupling and interacts with a corresponding coupling with a pressing cylinder.

This allows coupling the discharge line directly when the press cylinder is applied to the molded part. Separate coupling of the discharge line is no longer necessary; two steps are combined in one step.

A separate filling body for displacing media, e.g. water, may be provided between the molded part and the press cylinder, the filling body fills the casting mold, wherein the coupling or the drainage channel end extend through the filling body to the press cylinder.

The detachable coupling can be arranged in a central region of the molded part and in particular in a region at or adjacent to the center of mass of the molded part.

This area is preferably selected so that moments of inertia about an axis of the coupling can be minimized.

The detachable coupling is preferably designed in such a way that it can be gripped by a robot.

This allows lifting the molded part out of the casting mold without having to attach additional elements to the molded part. The coupling not only takes over the function of draining the water but also the function of providing an element for gripping and handling the molded part.

An additional gripping contour formed on the coupling or possibly a second blind coupling that prevents the molded part from twisting in one of the robot's gripper arms may be provided.

A further aspect of the invention relates to a process for forming a green compact comprising the steps a. Providing a molded part with at least one drainage channel which has at least one drainage channel end, in particular with a molded part described previously;
b. filling the molded part with a compound to be cast;
c. building up a pressure on the molded part to produce a blank;
d. draining liquid from the blank through the at least one drainage channel and a discharge line to produce a green compact by draining;
e. after dewatering, decoupling the discharge line from the end of the drainage channel;
f. gripping the casting mold or the molded part with a robot to open the casting mold and/or to demold the green compact.

Preferably the robot grips the casting mold at a coupling as described above.

The coupling can extend, for example, from the molded part through the filling body, so that when the robot grips the coupling at least part of the casting mold, such as a filling body, is lifted together with the molded part. It is also conceivable, however, to first remove the filling body and then use the robot to grip and remove the molded part at the coupling.

This allows for an easy production and shaping of a green compact.

A further aspect of the invention relates to a molded part for a casting mold, in particular a molded part as described in the present case, the molded part comprising a shell with a molded part surface for molding a product, in particular a ceramic product. The shell is at least partially fluid permeable. Channels are provided in the shell so that the molded part surface can be acted upon by a medium and in particular by air and/or water. The molded part has at least one media connection for connecting the channels to a media source, in particular to a compressed air source.

Here and in the following, channels mean separately formed channels and not the fluid connections within the shell, which are formed by the pores. The channels are typically designed as tubular connections.

Separate, unconnected channel systems within the shell make it possible to bring media, especially air, to specific locations of the molded part and especially the shell. This allows, for example, introducing air specifically and independently into the molded part.

The air can flow through the pores of the molded part surface up to the blank within the molded part and evenly detach it from the molded part surface without deforming the blank.

The channels are preferably arranged in such a way that each point of the molded part surface has a distance to at least one channel which is smaller than 50 mm and in particular smaller than 30 mm.

The molded part surface is the surface facing the molding space, i.e. the surface which is in contact with the compound or slurry during molding of the blank.

These maximum defined distances ensure that each area of the molded part surface is exposed to air.

Preferably, the channels extend over the shell up to a lateral flange. The media connection is preferably located at the flange.

The arrangement of the media connection at the flange facilitates uncoupling from an air supply line, namely the media source.

In addition, the arrangement of the media outlet at the flange allows the media to flow through the molded part to the end of the drainage channel.

It can be advantageous letting the channels run essentially radially from a central area of the shell to the flange.

The channels can be arranged in such a way that they do not reach the molded part surface. This means that the channels are located inside the molded part and have a closed cross-section.

This makes it possible to form a network of channels that extends over the entire shell and is spaced from the molded part surface.

Alternatively, it is conceivable that the channels are formed as depressions in a surface and the closed cross-section is only formed when the molded part is placed in the casting mold. A closed wall of the channels would then result from the casting mold and the molded part.

Preferably, the channels in the flange end in a circumferential collecting channel which is connected to the media connection.

This allows all channels to be simultaneously supplied with one media source, for example compressed air.

The blank in the molded part is thus evenly pressurized with compressed air, thus enabling the blank to be released from the molded part evenly.

A further aspect of the invention concerns a process for molding a green compact, in particular a process as described above. The process comprises the steps a. Providing a casting mold, preferably with at least one molded part as described above;
b. filling the casting mold with a mass to be cast;
c. building up a pressure on the casting mold to produce a blank;
d. draining the blank to produce a green compact;
e. removing the green compact from the casting mold by applying a media overpressure between a molded part surface and the green compact.

This enables the green compact to be detached evenly as described above.

It is advantageous to hold the green compact on a side of the green compact opposite the overpressure by means of negative pressure while the green compact is being released from the casting mold. This facilitates the demolding of the green compact.

Another aspect of the invention concerns a molded part, preferably a molded part as described above. The molded part has a porous shell and a filling body to displace an unnecessary cavity. The filling body and the shell are connected to each other by a detachable connection.

This allows the molded part and the filling body to be manufactured separately. It is also possible, for example, to remove the filling body separately after casting to facilitate handling of the molded part.

BRIEF DESCRIPTION OF THE DRAWINGS

The invention is explained by way of example with reference to the following figures. Show it.

DETAILED DESCRIPTION OF THE PREFERRED EMBODIMENTS

Figure 1:
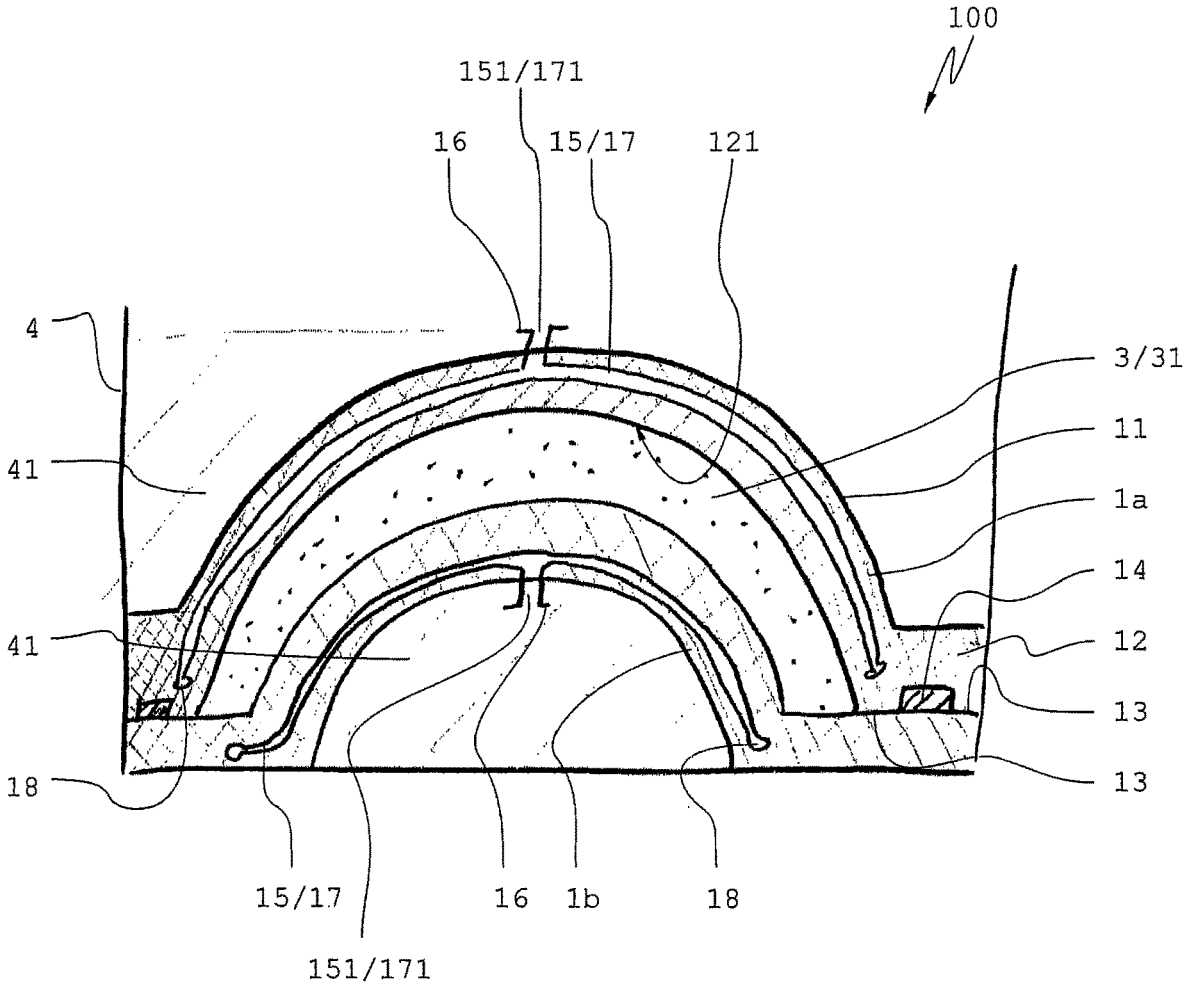
FIG. 1: a cross-section through a casting mold

FIG. 1 shows a cross-section through a casting mold 100, which has two molded parts 1*a* and 1*b*, which are arranged on top of each other in the concrete design example. A sealing 14 is arranged in the molded part 1*a* at the top in the present figure. The sealing 14 is located in a flange 12 of molded part 1*a*. Molded part 1*a* also has a shell 11, which is connected to flange 12. The second molded part 1*b* is designed in the same way as the first molded part 1*a*, with the difference that the second molded part 1*b* has no sealing. Therefore, only the structure of one of the molded parts 1*a* or 1*b* is explained below. As mentioned above, molded part 1*a* has a shell 11 and a flange 12, with a sealing 14 in flange 12. In the shell 12 there are drainage channels 15, which are connected to a drainage channel end 151. The drainage channel end 151 is also designed as coupling 16. Inside a mold space between the molded parts 1 there is a blank 3, which later becomes a green compact 31 as soon as the blank has been drained via the drainage channels 15. The shell 12 is porous and has a molded part surface 121 facing the blank 3.

Water can thus diffuse from the blank 3 through the porous shell into the drainage channels 15. It collects in the drainage channels 15 and can then be removed via the coupling 16. To accelerate this process, a negative pressure can be generated at the coupling 16, i.e. at the end of the drainage channel 151.

Figure 2:
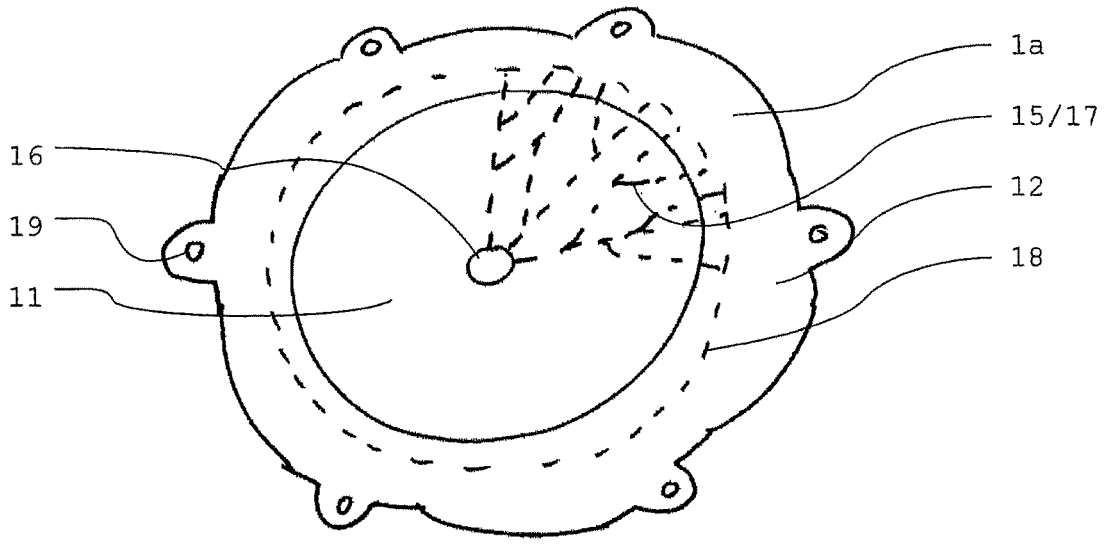
FIG. 2: a top view of the casting mold according to FIG. 1.

The drainage channels 15 are star-shaped with a center at coupling 16 (see FIG. 2). They open together into a collecting channel 18, which is designed as a circumferential ring channel in flange 12. In this case, the collection duct 18 and the drainage duct 15 simultaneously form an air duct 17.

It may be intended to provide a separate media connection at the flange, i.e. a separate air supply or air discharge pipe. This can extend through the flange 12 into the ring duct 18. It is also conceivable to provide a media duct network separate from the drainage ducts 15. This can be designed according to the drainage channel network and can, for example, be located adjacent to or in a parallel plane to drainage channels 15. Media connection 171 and drainage channel end 151 can be designed separately.

The molded parts 1*a*, 1*b* are arranged within a frame 4. The cavities that form between frame 4 and molded parts 1*a*, 1*b* are each filled with a filling body 41.

It is conceivable that the filling bodys 41 are each formed as separate elements. In this case, the filling bodys 41 can be connected to the respective molded part 1*a* or 1*b* with a detachable connection.

FIG. 2 shows a schematic top view of molded part 1*a* from FIG. 1. Molded part 1*a* has a coupling 16 essentially in the center. Drainage channels 15 are located in the shell 11 of molded part 1*a*. These drainage channels 15 extend from coupling 16 to flange 12 of molded part 1*a*. The drainage channels 15 are arranged essentially in a star shape, whereby the drainage channels 15 branch out the further away they are from the coupling 16. This limits the maximum distances between the individual drainage channels. In other words, an inner side of the molded part, namely a molded part surface 121 (see FIG. 1), is spaced from a drainage channel 15 with each point of the surface at a maximum distance (and presently at 50 mm).

For the sake of clarity, the channels are only shown in about a quarter of the shell. Naturally, other drainage channels 15 also extend into the remaining three quarters of the shell 11. The drainage channels 15 open into a circumferential collecting channel 18, which is located in flange 12 of molded part 1*a* (see FIGS. 1 and 3*k*).

At least two centering elements (six in the concrete design example) 19 are arranged on the periphery of the molded part 1*a*, which are designed as holes through which, for example, clamping screws can extend in the assembled state.

Figure 3A:
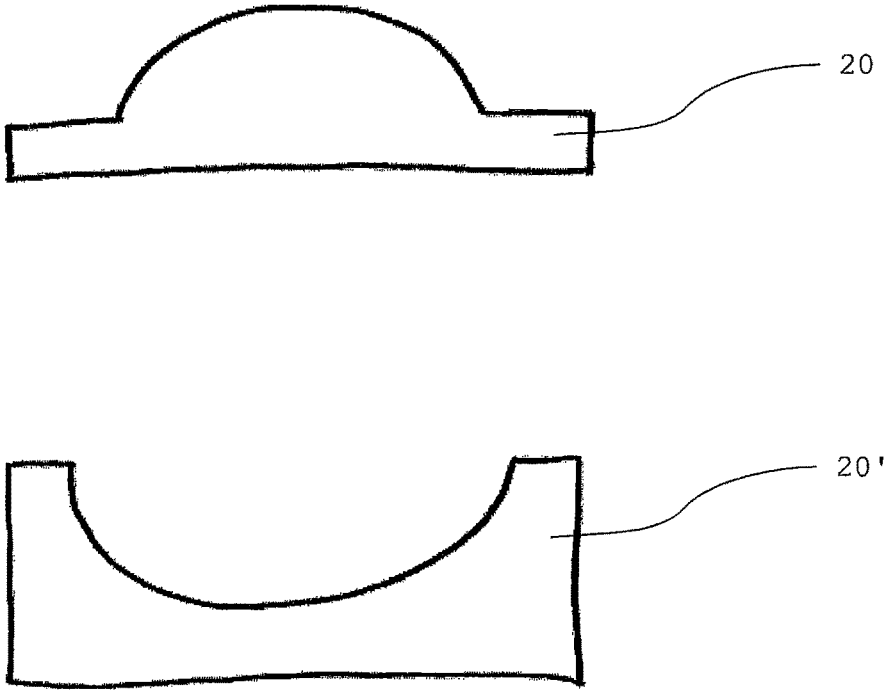
FIG. 3*a* to FIG. 3*m*: Process steps for producing a a molded part and a blank
Figure 3B:
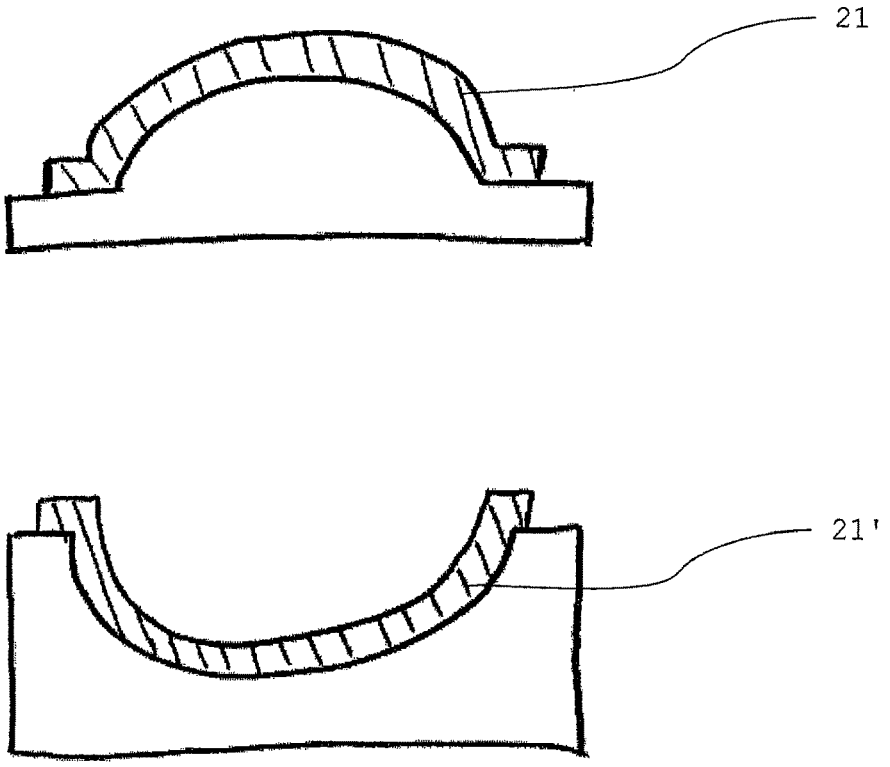
Figure 3C:
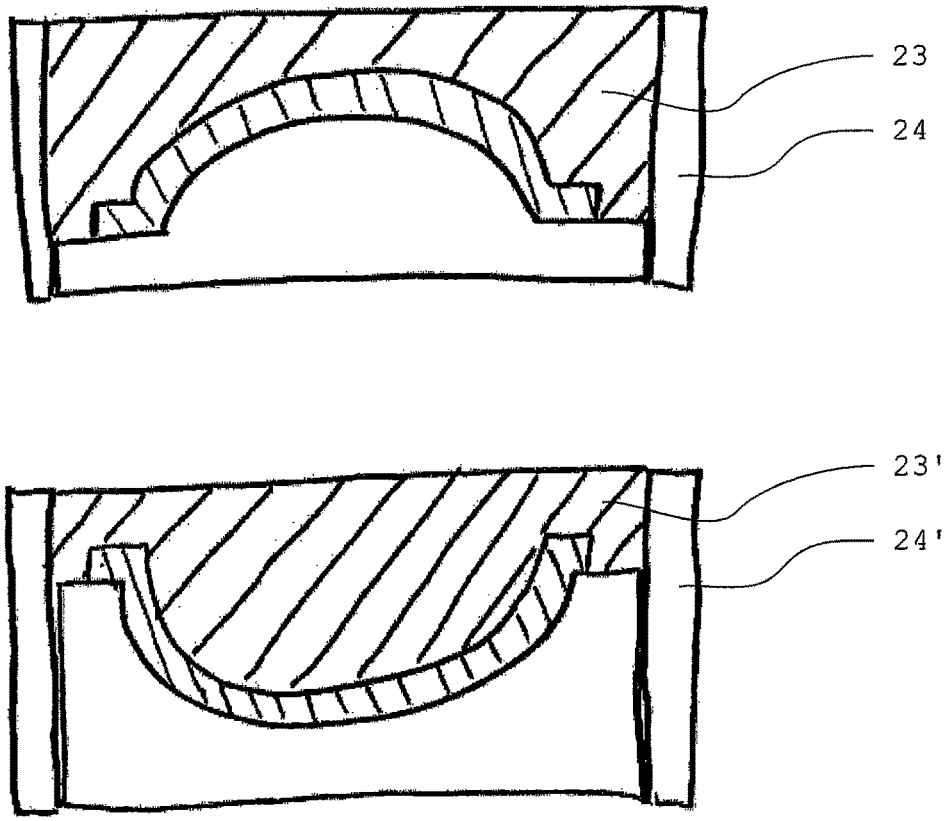
Figure 3D:
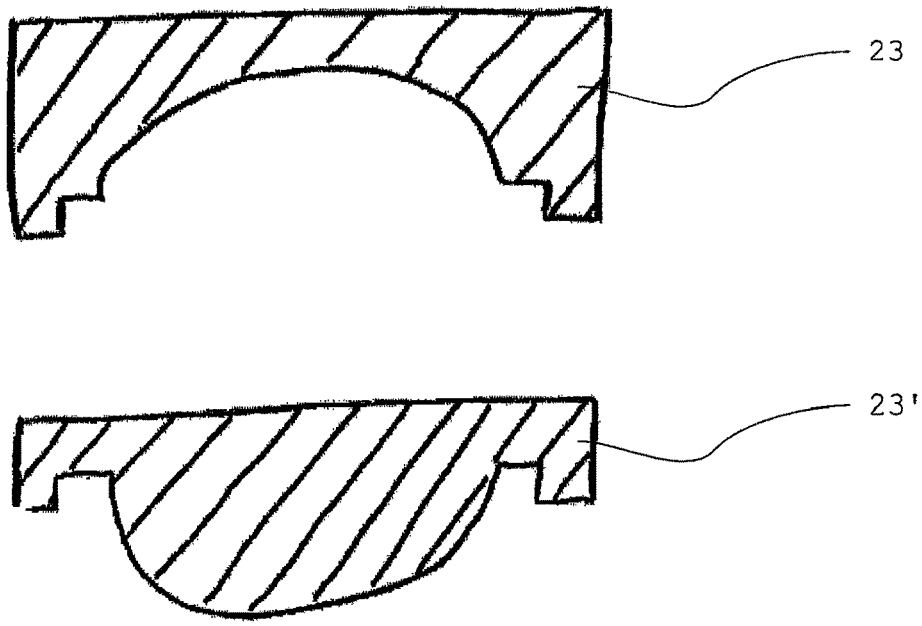
Figure 3E:
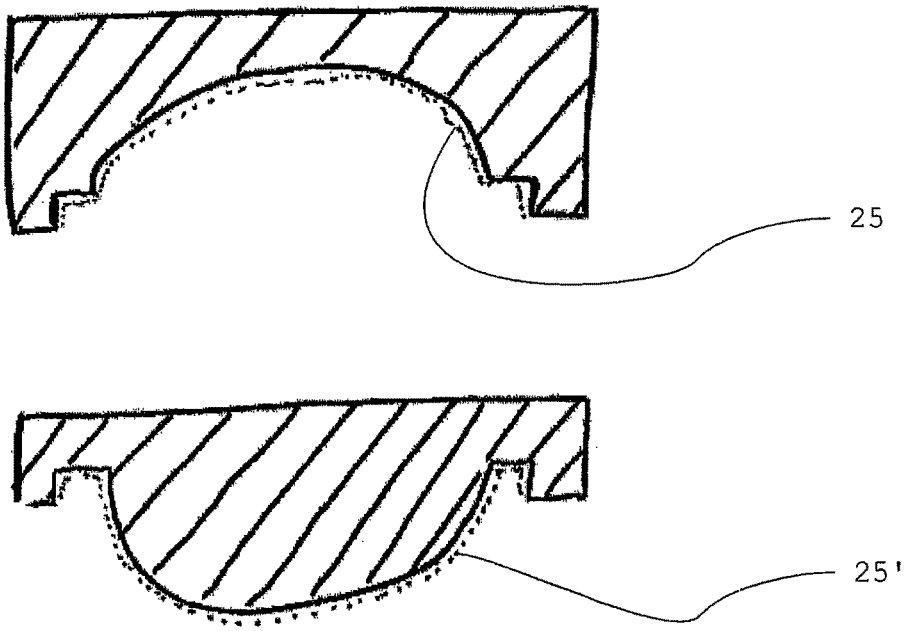
Figure 3F:
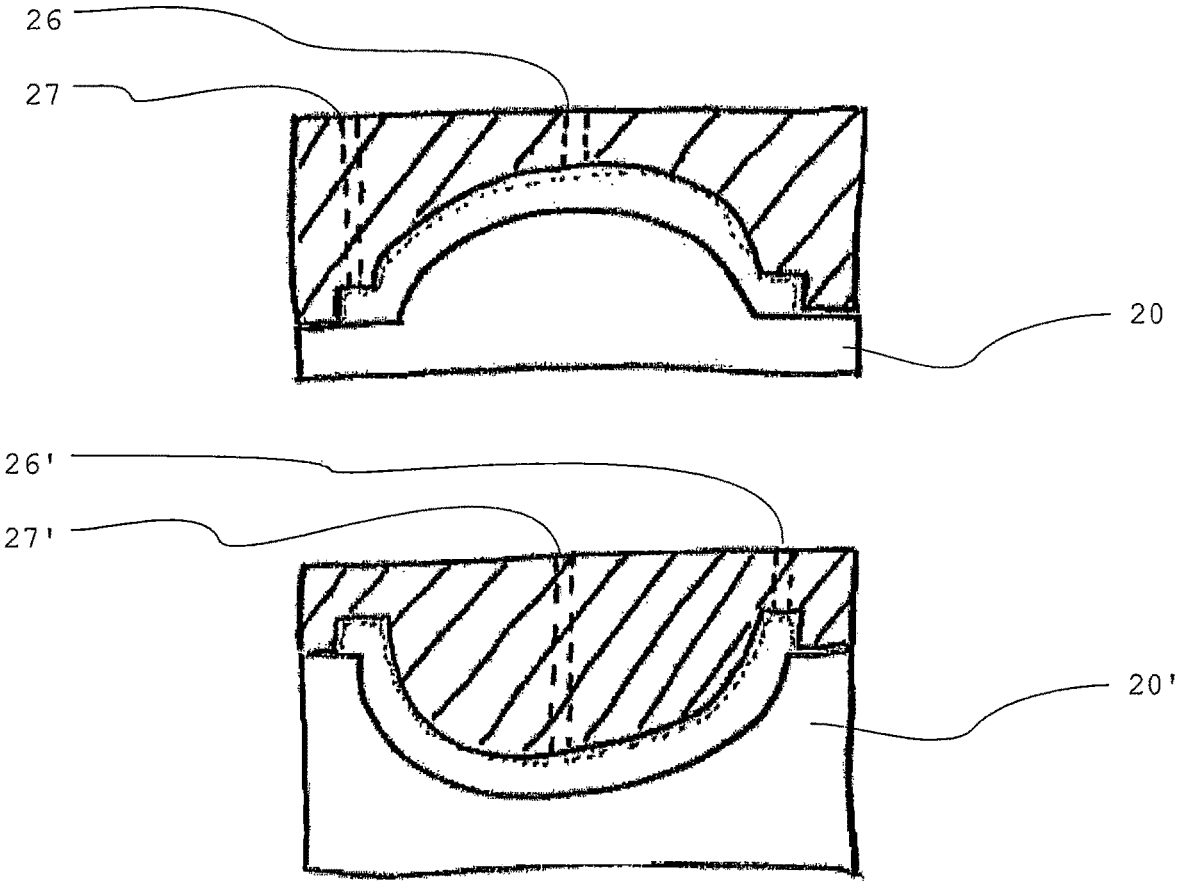
Figure 3G:
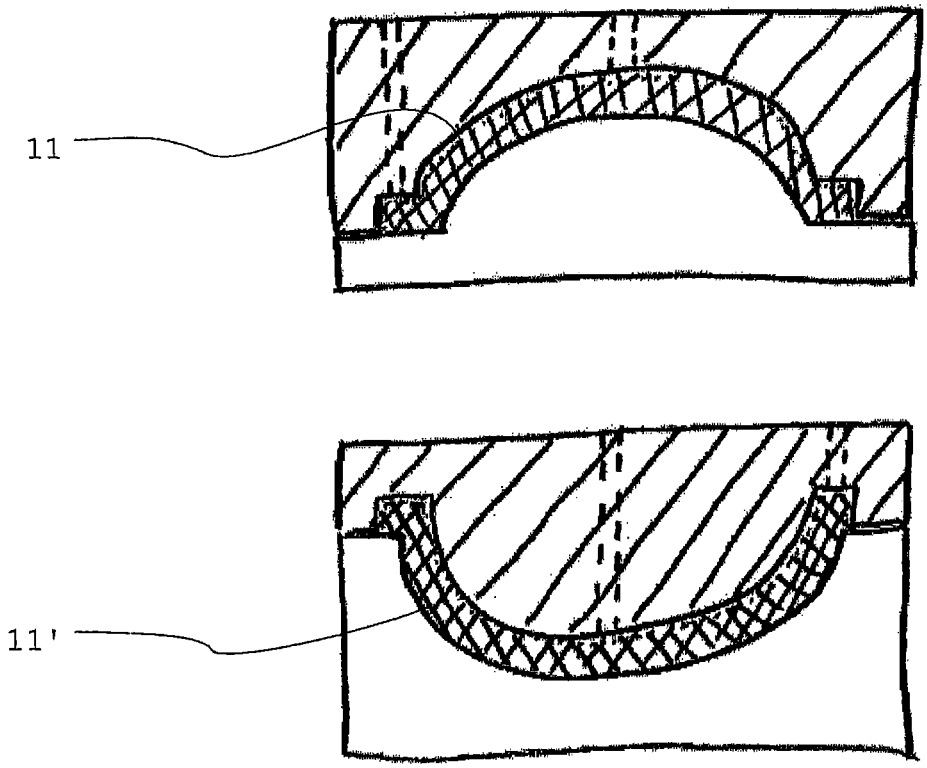
Figure 3H:
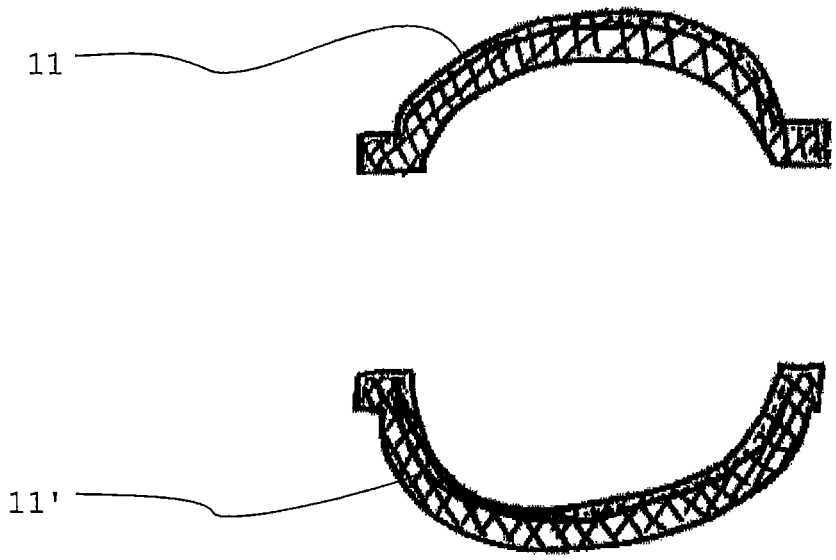
Figure 3I:
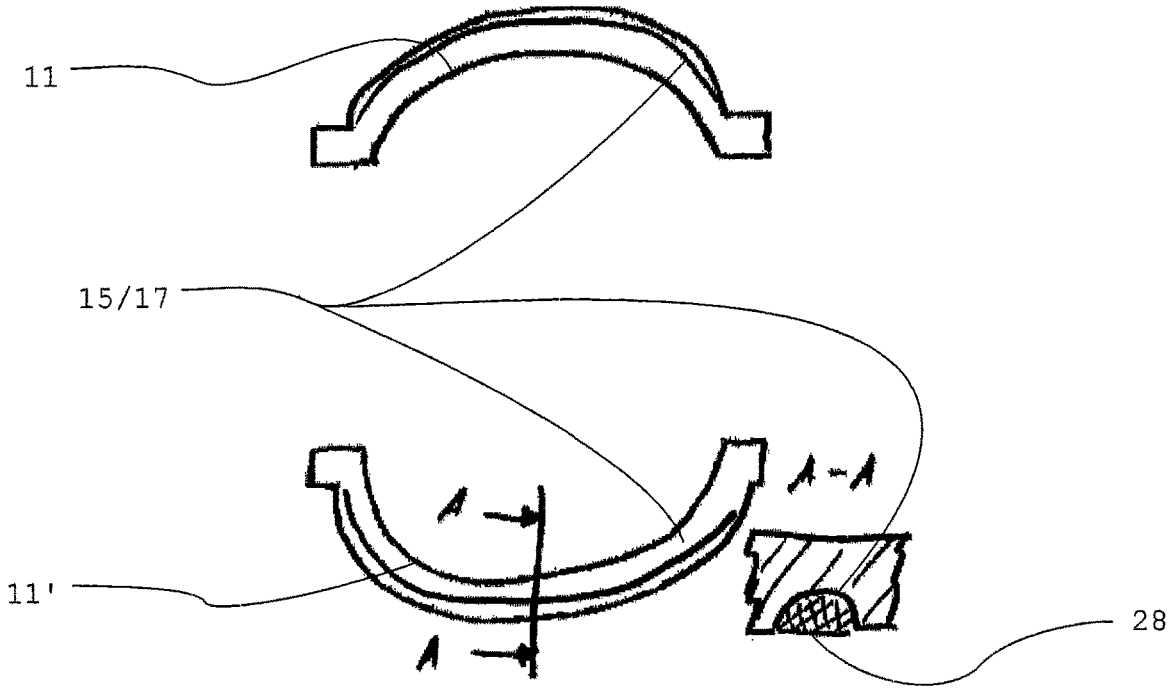
Figure 3J:
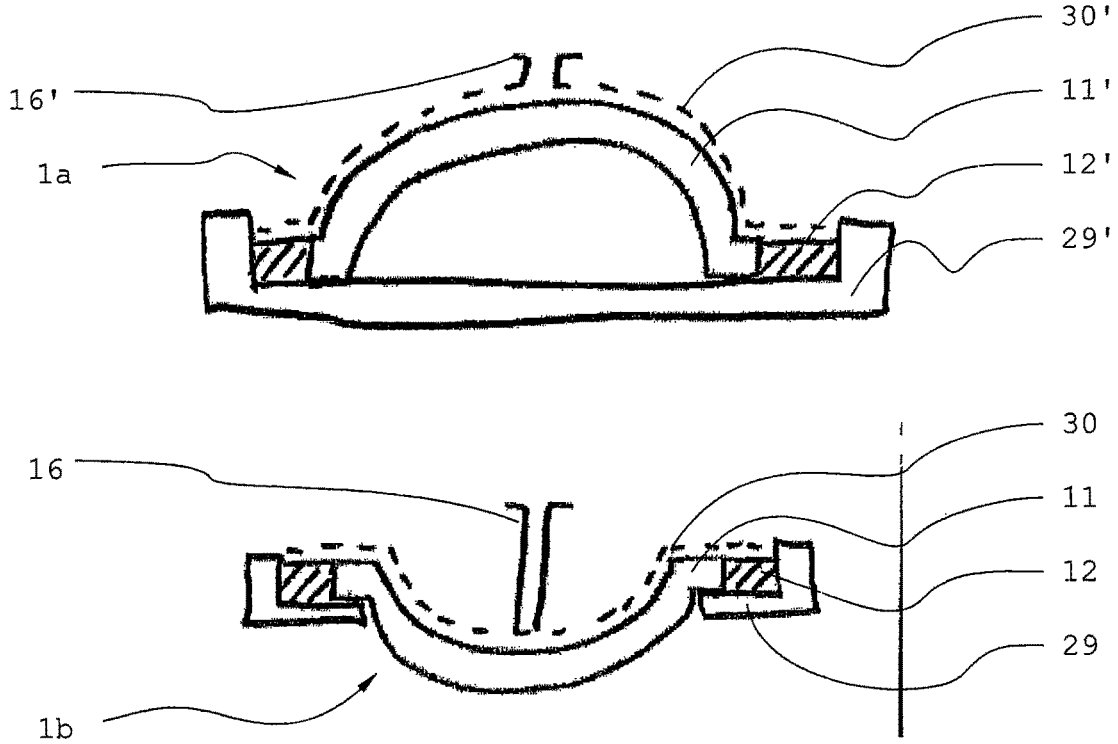
Figure 3K:
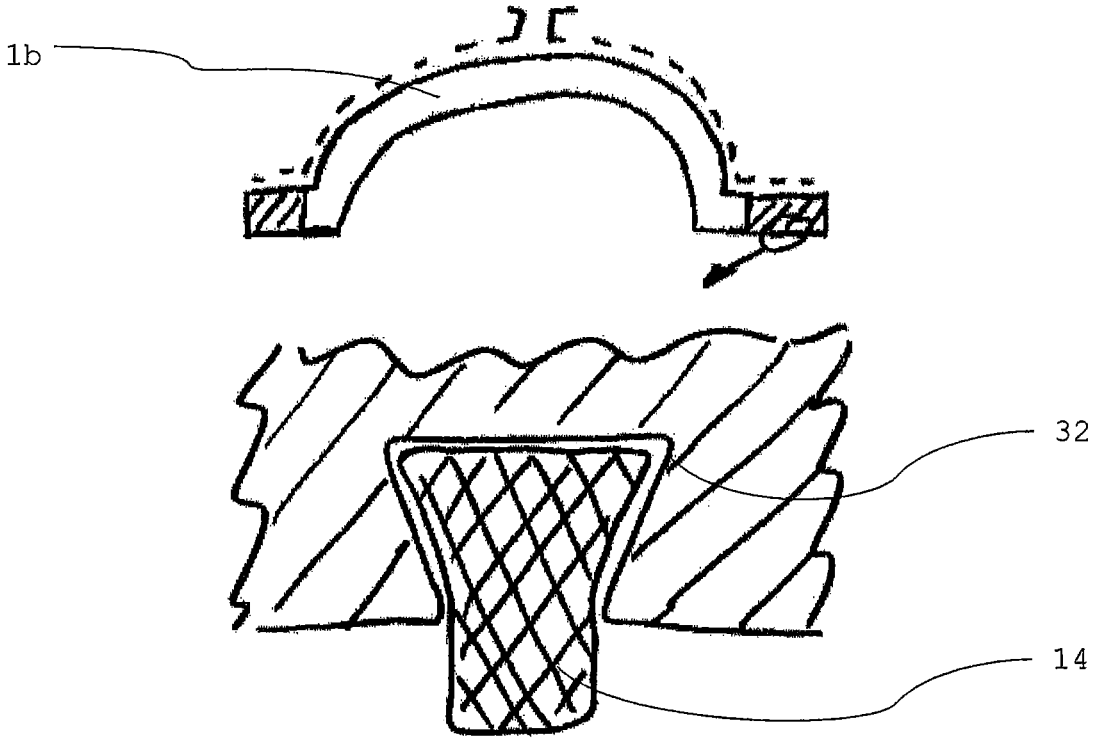
Figure 3L:
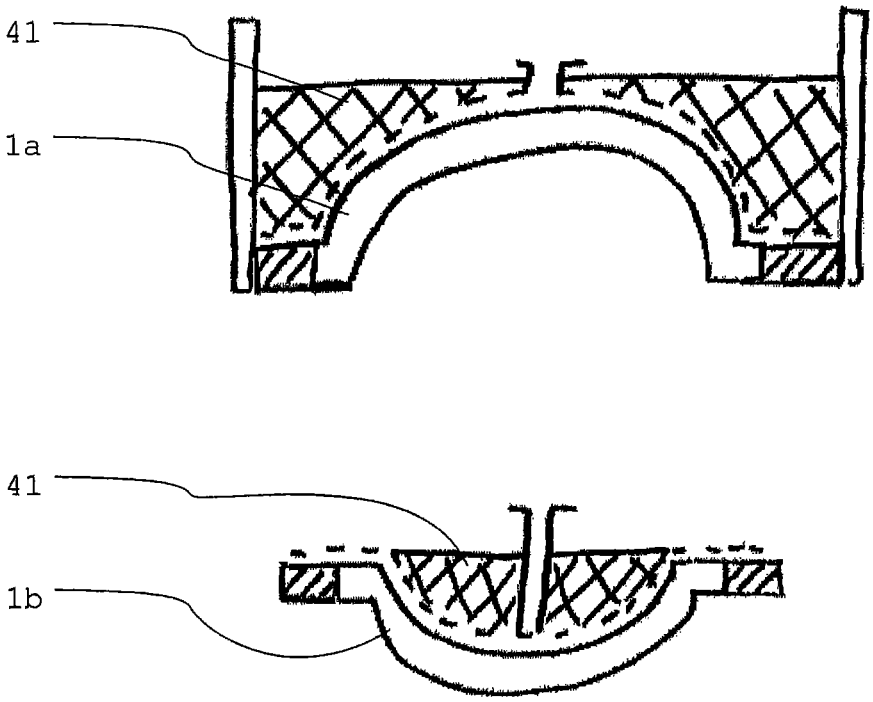
Figure 3M:
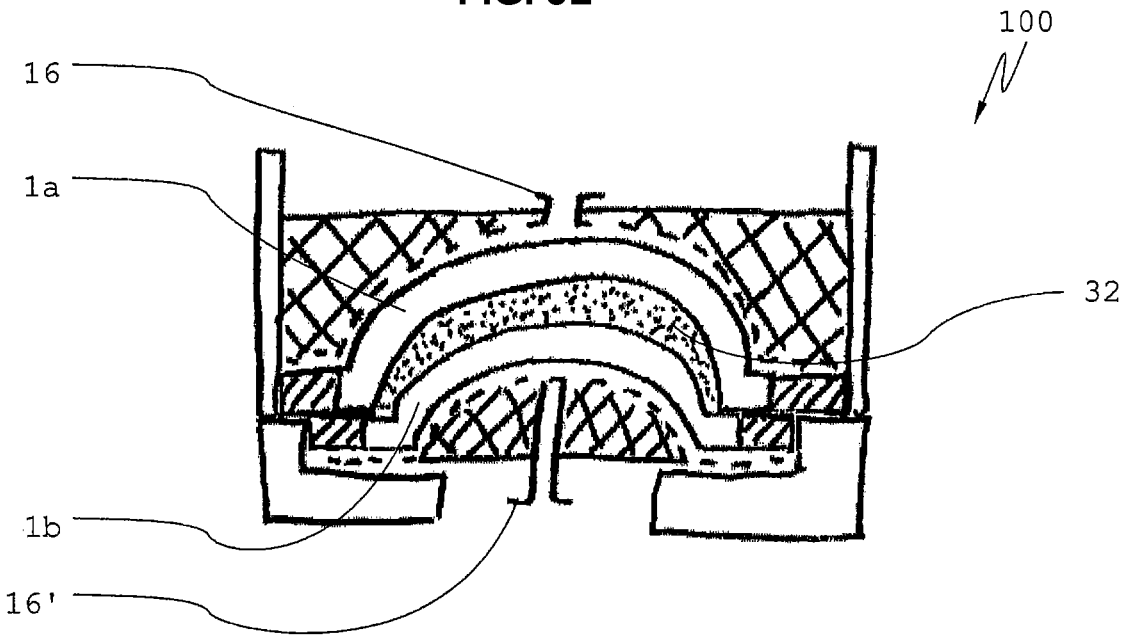

FIGS. 3*a* to 3*o* show a process for the production of a molded part 1*a*, 1*b* (see FIG. 1) as well as a blank and a green compact 31 (see FIG. 1 and FIG. 3*m*).

In FIGS. 3*a* to 3*o* the reference signs are mentioned only once, so that the overview is guaranteed.

FIG. 3*a* shows one casting 20 and one casting 20' each, which are made of plaster, for example. The casting devices 20 and 20' form the basis for the production of the molded parts.

As shown in FIG. 3*b*, these casting units 20 and 20' are each covered with an intermediate layer 21, e.g. plasticise. This layer is typically between 5 and 30 mm thick.

FIG. 3*c* shows the production of shell cores 23 and 23'. Typically, a box is built around the casting molds from FIG. 3*b* and the cavity is filled with plaster. These shell cores 23 and 23' harden and can be demolded after hardening, as shown in FIG. 3*d*. In the next step (FIG. 3*e*) a release agent 25, 25' is applied to the shell cores 23 and 23'.

In the next step (FIG. 3*f*) the shell cores are again sealed with the appropriate casting equipment 20, 20' (see FIG. 3*a*). This involves first making sprues 27, 27' and vents 26, 26' in the shell cores 23 and 23'. The respective shell cores 23 and 23' are firmly connected to the respective casting equipment 20 and 20'.

Porous mold material is introduced through sprue openings 27, 27' (FIG. 3*g*). In the cavity between the shell cores 23 and 23' and the respective casting device 20, 20' a shell 11, 11' of the later molded part 1*a* and 1*b* is molded.

After curing, these shells 11, 11' are demolded (see FIG. 3*h*).

In FIG. 3*i*, the shells 11, 11' from FIG. 3*a* are shown without hatching so that drainage and/or ventilation channels 15, 17 are visible in the shell. FIG. 3*i* also shows a cross-section of a drainage/ventilation channel 15, 17. These ducts are essentially U-shaped in the present case. After milling these channels 15, 17, they are filled with a recess material 28.

In a next step (FIG. 3*j*), the shells 11, 11' are each applied to a base 29, 29'. Then the corresponding flanges 12, 12' are cast onto each of the shells 11, 11'. After the flanges 12, 12' have hardened, the later backsides (i.e. the sides facing away from the green compact) of the shells 11, 11' are sealed with a material with a permeability of maximum 11/(h*dm$^2$*bar), so that channels 15, 17 (see FIG. 3*i*) are closed. In addition, a coupling 16 is fitted in the sealing layer with connection to the channels as a drainage channel end 151 and/or as a media connection 171.

In a further step (see FIG. 3*k*), a sealing groove 32 is milled into at least one of the shells 1*a* or 1*b* (see FIG. 3*f*) which are essentially finished here. The seal groove 32 is shown in FIG. 3*k* as a detailed cut-out. In the actual design example, this sealing groove has an undercut, i.e. it is wider at the bottom of the groove than at its open end. A sealing 14 made of silicone is then cast into this sealing groove 32, which is fixed by the undercut of the sealing groove 32.

Once the sealing has been installed, the molded parts 1*a* and 1*b* are separated from each other (see FIG. 3*l*) and, if necessary, placed in a suitable box. The resulting empty spaces are filled with a filling element with a density of less than 5 kg/dm3, which forms a filling body 41. The filling body can be designed in such a way that it is or can be detachably connected to the respective molded part 1*a* and 1*b*. Screw and/or snap connections can be provided.

After this filling element has hardened, molded parts 1*a* and 1*b* can be assembled in a casting mold 100 (see FIG. 3*m*, and also FIG. 1). After the molded parts have been firmly clamped with a press, the material to be cast can be introduced through the coupling into a cavity formed between molded parts 1*a* and 1*b*. Within this cavity, a blank or green compact is created.

When the slurry is introduced through the coupling into the mold cavity under slurry pressure, its solid parts settle on the walls of the mold cavity. Liquid and possibly air of the slip, however, can penetrate the porous shell, so that a solid body is formed on the walls of the mold cavity as a blank to be sintered later. The closing force exerted by the press serves as a counterforce to the slurry pressure and is thus greater than the slurry pressure p.

After draining the blank, molded part 1*a* as part of casting mold 100 (see FIGS. 3*o* and 3*n*) can be gripped by a robot at coupling 16 (FIG. 3*j*). At the same time, air can be blown in through the 16' coupling located on the bottom part of molded part 1*b* in FIG. 3*m* and a vacuum can be created on the 16' coupling located on the top part of molded part 1*a*. The negative pressure holds the blank 31 in place on the molded part 1*a*, while the introduction of air at the 16' coupling releases the blank 31 from the molded part 1*b*. The blank can then be released from molded part 1*a*. For this purpose, an overpressure must be generated at molded part 1*a*.

The invention claimed is:

1. A molded part for a casting mold, comprising at least one shell for casting a product, wherein a flange for sealingly abutting a sealing surface is arranged on an edge of the shell, and the shell has a first permeability to a fluid and the flange has a second permeability to the fluid which is less than the first permeability, wherein permeability is defined as the volume of a fluid which can be passed through a solid per hour, per square decimeter and per pressure: $l/(h*dm^2*bar)$, and wherein the permeability of the shell is at least 10 $l/(h*dm^2*bar)$ and the permeability of the flange is maximum 1 $l/(h*dm^2*bar)$.

2. The molded part according to claim 1, wherein the flange is cast onto the shell.

3. The molded part according to claim 1, wherein the molded part and the flange consist essentially of the same material.

4. The molded part according to claim 1, comprising a circumferential sealing, and the sealing being arranged in or on the flange.

5. The molded part according to claim 4, wherein the flange has a recess into which the sealing is inserted.

6. The molded part according to claim 5, wherein the recess has an undercut.

7. The molded part according to claim 1, wherein the molded part is constructed in several parts and has an inner and an outer layer.

8. A casting mold comprising at least one molded part according to claim 1.

* * * * *